US006945281B2

(12) United States Patent
Berktold et al.

(10) Patent No.: US 6,945,281 B2
(45) Date of Patent: Sep. 20, 2005

(54) WEAVING MACHINE WITH A NEEDLE BAR AND AN INSERTION ELEMENT FOR WARP THREADS

(75) Inventors: Klaus Berktold, Rueti (CH); Hans-Dieter Scorl, Rueti (CH)

(73) Assignee: Sultex AG, Rueti (CH)

( * ) Notice: Subject to any disclaimer, the term of this patent is extended or adjusted under 35 U.S.C. 154(b) by 136 days.

(21) Appl. No.: 10/404,230

(22) Filed: Mar. 31, 2003

(65) Prior Publication Data

US 2003/0188794 A1 Oct. 9, 2003

(51) Int. Cl.[7] ..... D03C 7/00
(52) U.S. Cl. ..... 139/50; 139/11
(58) Field of Search ..... 139/11, 50, 54

(56) References Cited

U.S. PATENT DOCUMENTS 5,419,375 A * 5/1995 Corain et al. ..... 139/54
6,510,587 B2 * 1/2003 Urschel et al. ..... 16/83

FOREIGN PATENT DOCUMENTS

DE 588059 C 10/1933
DE 646462 C 6/1937
FR 2174675 A 10/1973

* cited by examiner

*Primary Examiner*—John J. Calvert
*Assistant Examiner*—Andrew W. Sutton
(74) *Attorney, Agent, or Firm*—Townsend and Townsend and Crew LLP

(57) ABSTRACT

The weaving machine comprises a needle bar (3) and an insertion-element (4) with which warp threads (13, 14) are guided and which are two components of a shed forming apparatus for the manufacture of leno cloths (1). The two components are moved vertically in a reciprocal manner. A horizontal displacement movement (40*b*) transverse to the direction of the warp thread is executed with the insertion element in addition to the vertical movement (40*a*) The movements of the two components cause a leno binding to take place in interplay with the insertion of a weft thread (12, 12'). The shed forming apparatus can be modified such that, on the one hand, the horizontal displacement movement (40*b*) of the insertion element is switched off and, on the other hand, for both components a stroke (h) of the vertical movement (30, 40*a*) is in each case increased and controlled in such a manner that a cloth without leno binding, in particular a simple cloth (1'), can be manufactured.

10 Claims, 4 Drawing Sheets

WEAVING MACHINE WITH A NEEDLE BAR AND AN INSERTION ELEMENT FOR WARP THREADS

BACKGROUND OF THE INVENTION

The invention relates to a weaving machine with a needle bar and an insertion element for warp threads. Leno cloths can be manufactured with a weaving machine of this kind. The invention also includes the use of the weaving machine in accordance with the invention.

In a method for the manufacture of leno cloths a leno harness is used which consists of two elements, with the one element serving for the guidance of leno threads and the other element serving for the guidance of ground threads. The leno threads and ground threads are warp threads. The element for the ground threads can for example be a needle bar, which is an arrangement of needles with eyes which are transversely disposed with respect to the warp threads. The element for the leno threads can be an insertion element, which is an insertion rail with a linear series of holes. The insertion element is moved up and down as well as back and forth with respect to the needle bar. The vertical guidance movement of the leno threads is a first component of movement, onto which a second component of movement is superimposed with the help of a suitably designed frame. The leno threads are periodically displaced laterally by the insertion element; i.e. a cyclical displacement movement is executed, so that the binding which is typical for leno cloths takes place through the change of position of the leno threads. As a result of the change of position of the leno threads the positions of the leno threads are located alternately to the left and to the right of the ground threads, and with each change of position the shed is opened for a weft insertion.

Leno cloths can be used in the manufacture of tufted carpets. In the manufacture of these carpets a pile yarn and a prefabricated base cloth are used. The threads of the pile yarn are punched into the base cloth by means of a tufting machine. The pile threads form loops (pile loops), which are cut open for example in the case of pile rugs. The pile yarn is fixed to the base cloth through application of an adhesive bonding means, for example latex, to the reverse side of the carpet. A leno cloth is additionally adhesively bonded to the reverse side of the carpet for a reinforcement of the carpet. The manufacturer of reinforced tufted carpets of this kind requires in addition to a tufting machine two types of weaving machines, on the one hand for the manufacture of the base cloth, namely a 1/1 cloth, and on the other hand for the manufacture of the leno cloth. The 1/1 cloth, the binding of which is a canvas binding, will be designated in the following as a "simple cloth".

SUMMARY OF THE INVENTION

This requirement of having to use two types of weaving machine is considered to be disadvantageous. The need for overcoming this disadvantageous requirement led to the subject matter or object of the present invention. This subject matter is a weaving machine by means of which both the simple cloth and the leno cloth can be manufactured. What had previously required two weaving machine types, namely the weaving of two kinds of cloth for the purpose of manufacturing the named tufted carpet, is now possible with only one type of machine. The weaving machine of the present invention also enables the manufacture of cloths other than simple or leno cloths.

The weaving machine comprises a needle bar and an insertion element with which warp threads are guided and which are two components of a shed forming apparatus for the manufacture of leno cloths. The two components are moved vertically in a reciprocal manner. A horizontal displacement movement transverse to the direction of the warp threads is executed with the insertion element in addition to the vertical movement. The movements of the two components cause a leno binding to take place in interplay with the insertion of a weft thread. The shed forming apparatus can be modified such that, on the one hand, the horizontal displacement movement of the insertion element is switched off and, on the other hand, for both components a stroke of the vertical movement is in each case increased and controlled in such a manner that a cloth without leno binding, in particular a simple cloth, can be manufactured.

In the following the invention will be explained with reference to the drawings.

DESCRIPTION OF THE PREFERRED EMBODIMENTS

Figure 1:
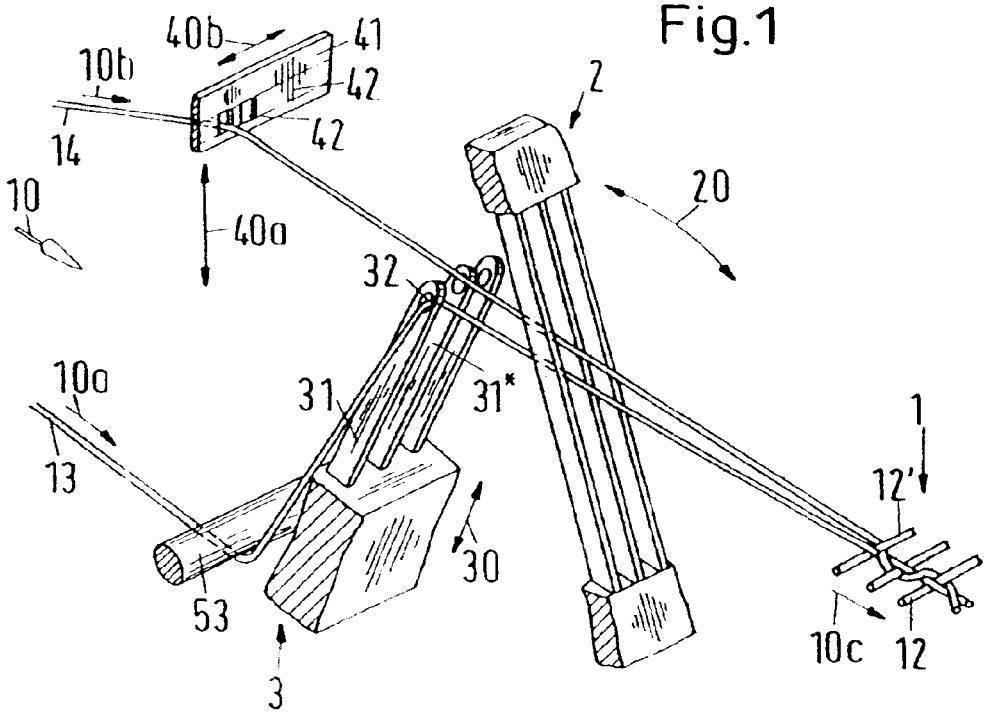
FIG. 1 is an illustration for the purpose of spatial illustration of a method for the manufacture of leno cloths.
Figure 2:
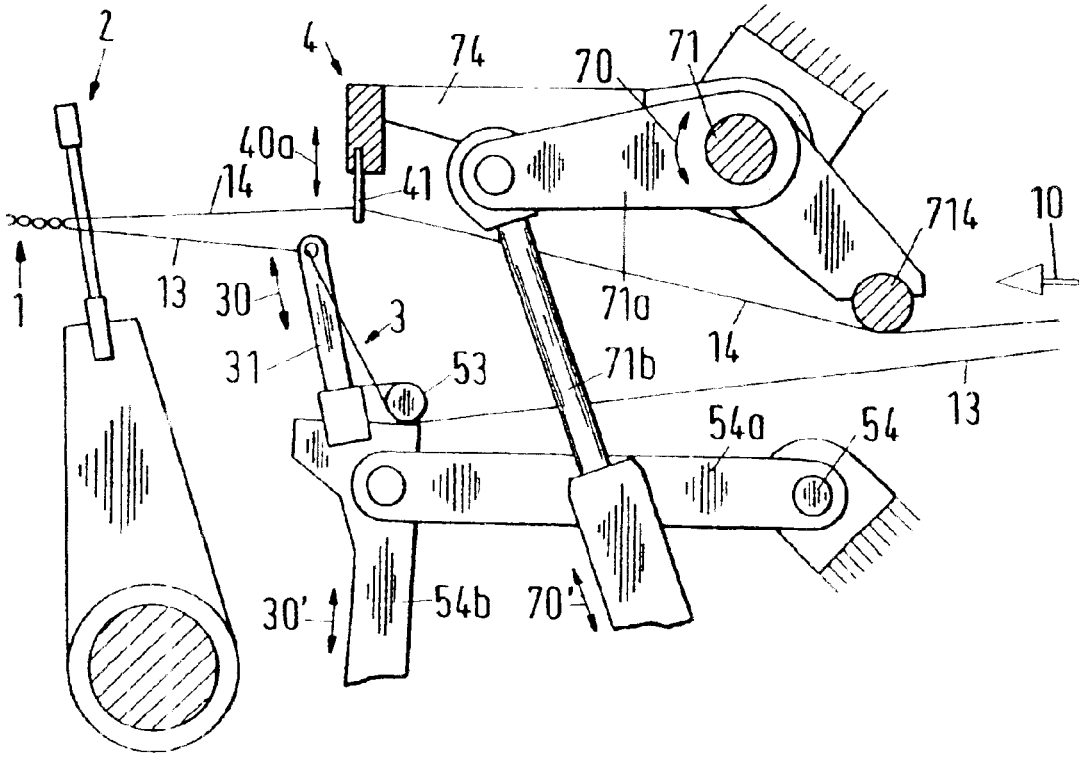
FIG. 2 is a side view of a partly illustrated weaving machine with a shed forming apparatus for the manufacture of leno cloths.

As illustrated in FIGS. 1 and 2, a leno cloth 1 is manufactured of weft threads 12 and warp threads, namely ground threads 13 and leno threads 14. In this the ground threads 13 are guided with a needle bar 3 and the leno threads 14 are guided with an insertion element 4. The needle bar 3 carries ground needles 31 with eyes 32, which are relatively stiff eyed bars. The insertion element 4 contains an insertion rail 41, which is a perforated rail with holes 42. A series of regularly arranged holes 42 is indicated in chain-dotted lines as a strip 42'. In FIG. 1 the transport direction 10 of the warp threads 13 and 14 (arrows 10*a* and 10*b* respectively) and of the cloth 1 (arrow 10*c*) extends from rear to front. In the corresponding arrangement of FIG. 2 the transport direction 10 extends from right to left.

For the beating up of a newly inserted weft thread 12' a reed 2 between the needle bar 3 and the cloth 1 is actuated: double arrow 20. The needle bar 3 and the insertion element 4 are moved up and down in contrary senses: double arrows 30 and 40*a* respectively. Onto the first component of movement 40*a* of the insertion rail 41, there is superimposed a second component of movement in the form of a displacement movement 40*b*. The stroke of the displacement movement 40*b* is chosen such that the leno thread 14 is moved in each case from a first gap, which lies between adjacent ground needles 31 and 31*, to a second gap, which is adjacent to the first. After a weft insertion this change of position of the leno thread 14 is again carried out in the opposite direction. In order that the first component of movement 40*a* of the insertion element 4 can take place outside the region of ground threads 13, the latter are deflected downwardly via a deflection bar 53.

The insertion element 4 and the needle bar 3 can be moved by an only partly illustrated pivotal arrangement, which can be connected via a drive shaft (81 in FIG. 3) to a main drive of the weaving machine, so that the sequence of movement results which is required for the ground and leno threads 13 and 14 respectively for the forming of a shed for the weft insertion.

The needle bar 3 is arranged between a first axle 61 (FIG. 3) of the pivotal arrangement and a stationary joint 54 at a first multiple lever 54*a*, 54*b*, 54*c*, which forms a four-bar mechanism. In this the needle bar 3 is firmly connected to a thrust lever 54*b*. The four-bar mechanism is journalled at a fixed location at the point of rotation of the joint 54. It is driven via a drive lever 54*c*, which is connected to the stationary pivotal shaft 61 (first axle). The movement 30 of the needle bar 3 results from an up and down movement 30' of the thrust lever 54*b*.

A second stationary axle 71, which is arranged parallel to the first axle 61, is driven in an opposite sense with a second multiple lever 71*a*, 71*b*, 71*c*, with this driving taking place through a drive lever 71*c*, which is connected to the pivotal shaft 61, via a thrust bar 71*b* and a drive lever 71*a*. The second axle 71 is set into a pendulum rotation 70 in the opposite sense with respect to the first axle 61 via the second multiple lever 71*a*, 71*b*, 71*c* and an up and down movement 70', which takes place reciprocally to the movement 30'. A lever 74, which connects the second axle 71 to the insertion element 4, transmits the pivotal movement and thus produces the vertical component of movement 40*a* of the insertion element 4. The horizontal component of movement 40*b* is produced by a mechanism which is not further illustrated (for this, cf. the European patent application No. 02405077.5). A leno-thread deflection bar 714, which serves for the temporary tensioning of the leno threads 14, is attached to the second axle 71.

Figure 3:
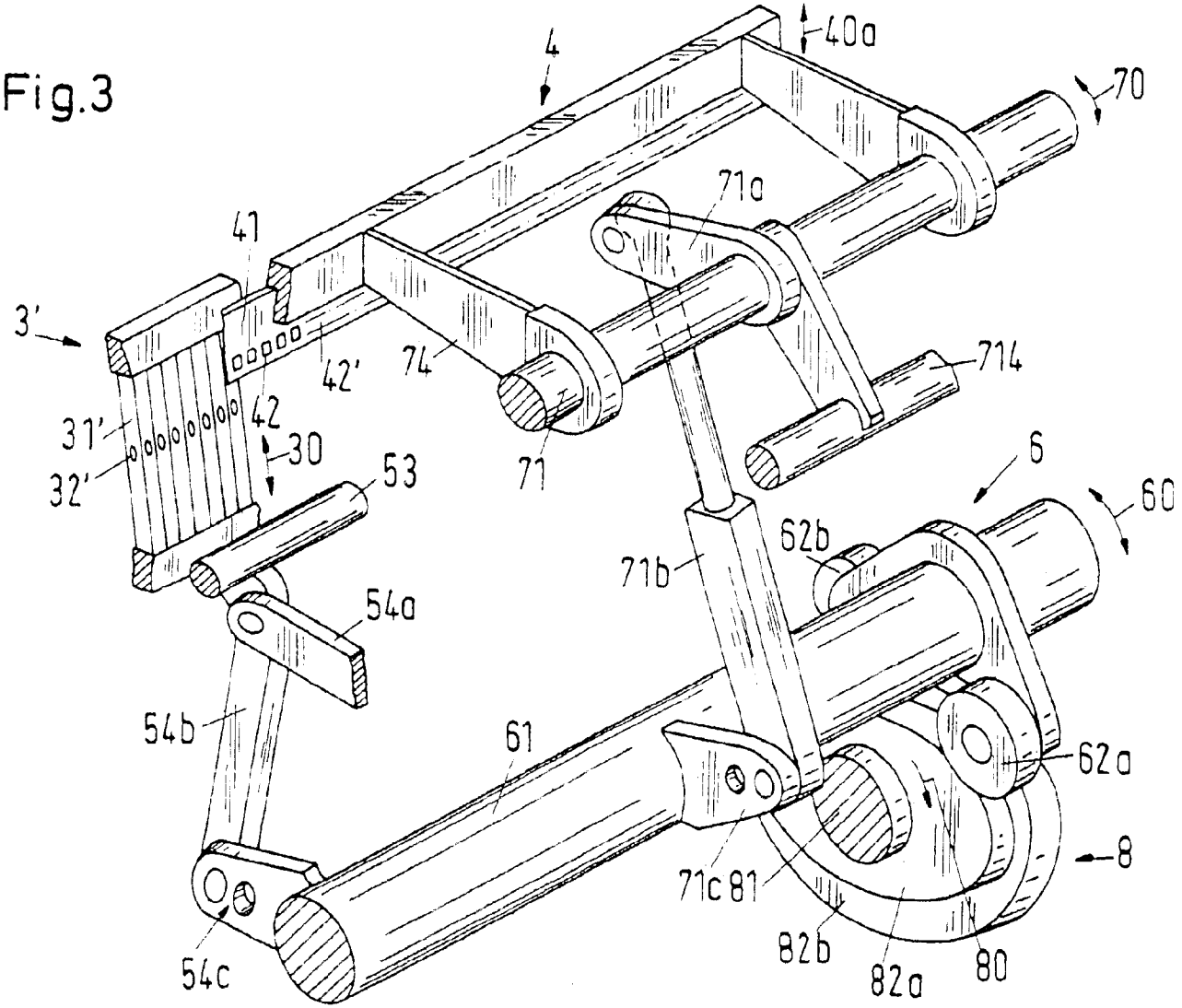
FIG. 3 is a perspective view of the modified shed forming apparatus, with which, for example, simple cloths can be manufactured.

The pivotal arrangement of the shed forming apparatus which is illustrated in FIG. 3 is in the modified form, in which a simple cloth 1' (FIGS. 4, 5) can be manufactured. The needle bar 3 has been replaced by an eyed blade or reed 3' (with lamella 31', 32'). The pivotal arrangement, by means of which the insertion element 4 and the eyed blade 3' are moved, is connected up to the main drive of the weaving machine via a shaft 81. A drive power is transmitted from the shaft 81 (rotational movement 80) via cam discs 82*a*, 82*b* to a cam disc drive 6. The insertion element 4 is moved in the vertical direction only. Thus the canvas binding of the simple cloth 1' takes place.

The pivotal arrangement comprises the first axle 61 and the second, oppositely movable axle 71, which are aligned parallel to the insertion path of the weft threads 12 (FIG. 1) and are journalled at fixed positions in non-illustrated side walls of the weaving machine. The first axle 61 is set into a pendulum rotation 60 through the cam disc drive 6 via the cam discs 82*a*, 82*b* and corresponding rollers 62*a*, 62*b*.

The eyed blade 3' is arranged at the first multiple lever 54*a*, 54*b* between the first axle 61 and the stationary joint 54 (FIG. 2). The second axle 71 is set into a pendulum rotation 70 which is reversed with respect to the first axle 61 via the second multiple lever 71*a*, 71*b*. A connection 74 between the second axle 71 and the insertion element 4 transmits the pivotal movement to the latter and thus produces the vertical component of movement 40*a* of the insertion rail 41.

The setting of the stroke for the vertical movements 40*a* and 30 of the insertion element 4 and of the eyed blade 3' respectively can be carried out at the two multiple levers, namely with two-hole levers 71*c* and 54*c* respectively, which in each case have two joint holes, with the one joint hole being assigned to the manufacture of the simple cloth 1' and the other joint hole being assigned to the manufacture of the leno cloth 1. Instead of the two joint holes, an elongate hole ("elongate-hole lever") can also be provided; or instead of two, more than two holes can also be provided as joint holes ("multiple-hole lever"). If a change is made back to the manufacture of leno cloths 1, a shorter stroke is required. The setting of the stroke through a lever shortening is carried out through adaptation of the two-hole levers 71*c* and 54*c* respectively (or multiple-hole or elongate-hole levers respectively) in that a change is again made to the other joint holes.

The setting of the stroke can also be carried out differently. For example, in addition to a first set of cam discs 82*a*, 82*b* and the corresponding cam disc drive 6, which are used during the weaving of the leno cloth, a second set can be provided, which can be brought into the active position for the replacement of the first set.

For the execution of the lateral displacement movement 40*b*, which is required in the manufacture of leno cloths 1, the insertion element 4 is movably arranged at the pivotal arrangement. The displacement movement 40*b* is driven by means of a non-illustrated motor, which acts at the insertion element 4, and which can in particular be a linear motor. This motor is switched off during the manufacture of the simple cloth 1'. The insertion element 4 is flexibly secured to the second axle 71 via elements 74, which are designed as leaf springs.

Figure 4:
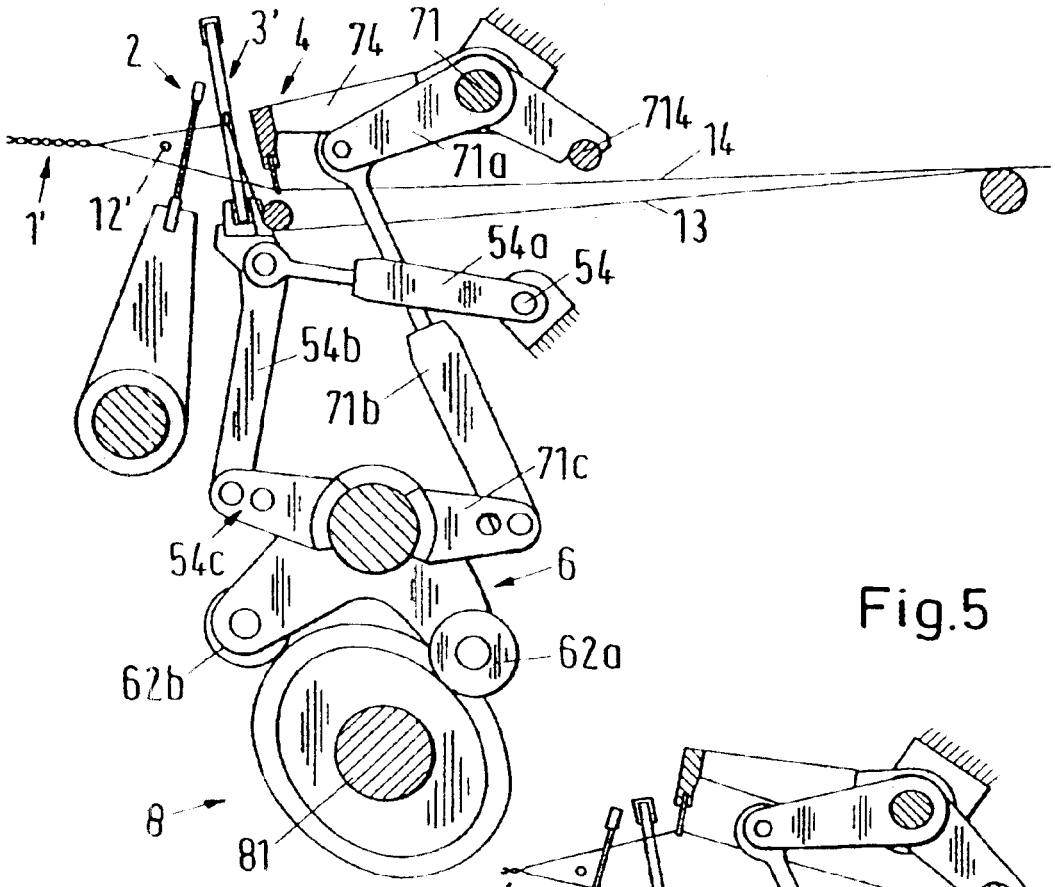
FIGS. 4, 5 are side views of the shed forming apparatus, which is illustrated in two working states.
Figure 5:
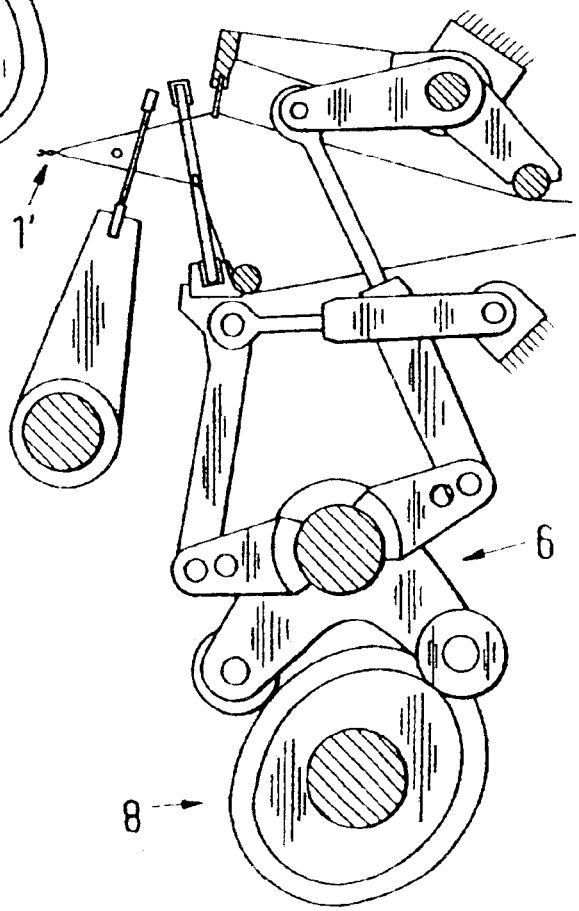

FIGS. 4 and 5 show a side view of the shed forming apparatus of FIG. 3. Two working states in the manufacture of the simple cloth 1' are illustrated. In both states the shed which is formed by the warp threads 13 and 14 is open. A weft thread 12 which is inserted into the shed but is not yet beaten up is drawn in. In FIG. 4 the eyed blade 3' is in an upper position, the insertion element 4 in a lower position; in FIG. 5 the situation is reversed. The individual components of the shed forming apparatus were already described with reference to FIG. 3. In the example shown the cam disc drive 8 is a 1:2 stroke-cam arrangement. With this arrangement 8 two weft insertion cycles are carried out per rotation of the drive shaft 81.

For the manufacture of the base cloth 1 a second cam arrangement 8 can be provided on the shaft 81 in the form of change gear wheels, with which a transmission ratio of 1:1 results.

Figure 6:
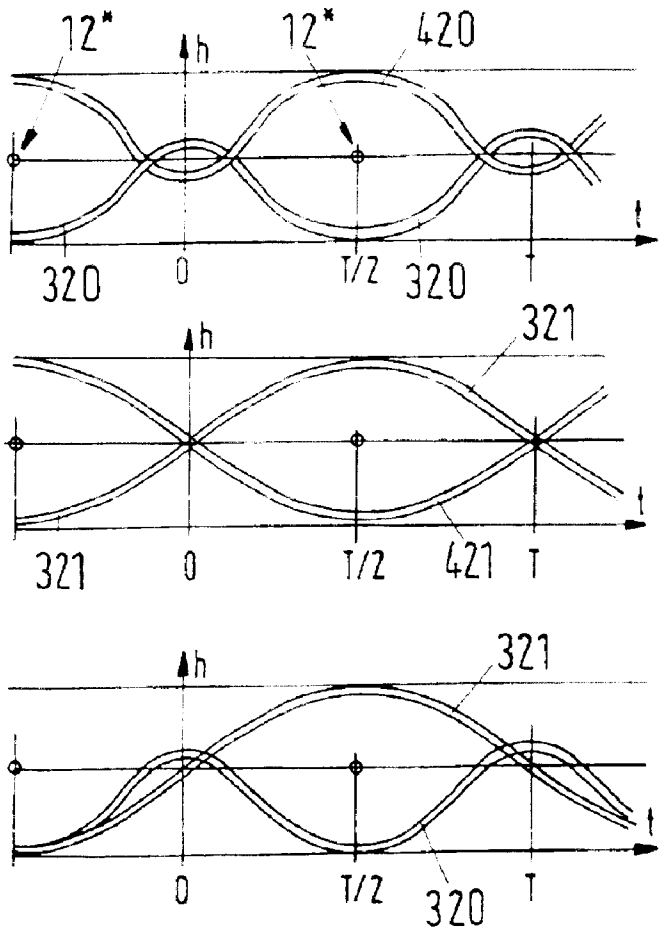
FIG. 6 shows diagrams which reproduce the sequence of movement of the shed forming components for the weaving machine in accordance with the invention.

FIG. 6 shows three diagrams which reproduce the sequence of movement of the shed forming components for the weaving machine in accordance with the invention, with the stroke h being plotted in the direction of the ordinate. The upper diagram illustrates the curves 320 and 420 along which the eyes 32 and holes 42 respectively move during the manufacture of a leno cloth in dependence on the time t. T is the cycle time of the weaving machine. At the time point t=T/2 a weft insertion 12* takes place. Corresponding stroke curves 321 and 421 of the eyes 32 and holes 42 respectively for the simple cloth are shown in the middle diagram. In the lower diagram the two stroke curves 320 and 321 are again plotted for comparison. As can be seen, the eyes 32 execute a full stroke in the case of the simple cloth (curve 321), whereas they execute a half stroke (curve 320) for the leno cloth. A corresponding difference between full and half stroke is also present for the holes 42.

Figure 7:
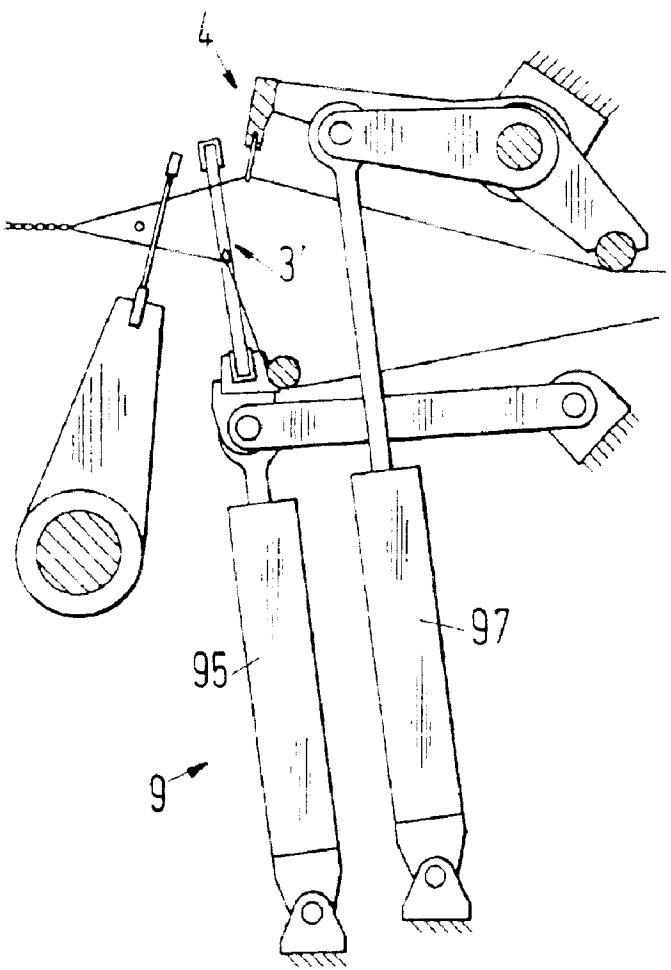
FIG. 7 shows a further embodiment of a shed forming apparatus.

FIG. 7 shows a further embodiment of a shed forming apparatus, in which another drive 9 is used for the shed forming components (needle bar 3 or eyed blade 3' respectively and for the insertion element 4). In this drive 9 the two shed forming components are each moved by separate setting means 95 and 97. The setting means 95 and 97 respectively can each comprise a plurality of parallel setting means, which are arranged to be distributed over the weaving width. The number of the setting means and their performance parameters depend on the weaving width and the work forces to be transmitted. Electrical, electromagnetic or fluidic setting means can be used. With such setting means a high degree of flexibility in the adaptation of the stroke h is achieved. The stroke curves 320, 420 or 321, 421 which are shown in FIG. 6 can thus easily be varied. A conversion by the manufacturer from one cloth kind to another is significantly simplified. (A shed forming apparatus of this kind with setting means is also suitable as a "conversion kit" for all kinds of flat weaving systems, including ribbon weaving machines and broad weaving machines (broadlooms).)

The weaving machine in accordance with the invention can be used in accordance with the introduction for weaving simple and/or leno cloths, with these cloths being provided for the manufacture of carpets, in particular the above-named tufted carpets. Other uses are of course also possible.

A plurality of weaving machines in accordance with the invention can be used for weaving simple and/or leno cloths at the same time. In this, individual weaving machines can also be used phase-wise for weaving simple cloths and, after an adaptation in each case of the shed forming apparatus, phase-wise for weaving leno cloths. A flexible reaction to a variable demand for the one or the other of the two cloth kinds is thus possible.

What is claimed is:

1. Weaving machine comprising a needle bar (3) and an insertion element (4) for warp threads (13, 14), which are components of a shed forming apparatus for the manufacture of leno cloths (1), with the two components being vertically movable in a reciprocal manner and with a horizontal displacement movement (40*b*) transverse to the direction of the warp threads being executable with the insertion element in addition to the vertical movement (40*a*), so that a leno binding arises in interplay with an insertion of a weft thread (12, 12')

characterized in that the shed forming apparatus is modifiable for the switching off the horizontal displacement movement (40*b*) of the insertion element and increases the stroke of for both components (h) of the vertical movement (30, 40*a*) and controlled such that a cloth without leno binding, is manufactured.

2. Weaving machine in accordance with claim 1, characterized in that the cloth is manufacturable without a leno binding through alternating, equal and opposite lifting and lowering of the needle bar (3) and/or of the insertion element (4) respectively.

3. Weaving machine in accordance with claim 1, characterized in that the needle bar (3) is replaceable by an eyed blade (3') which is upwardly and downwardly closed, with it being possible for the eyed blade to carry lamella (31') with eyes (32').

4. Weaving machine in accordance with claim 1, characterized in that the shed forming apparatus comprises a pivotal arrangement (6, 7, 8) with which the insertion element (4) as well as the needle bar (3) is movable, with a drive shaft (81) connected to a main drive of the weaving machine.

5. Weaving machine in accordance with claim 4, characterized in that the pivotal arrangement (6, 7, 8) comprises a first axle (61) and a second, oppositely movable axle (71), which are aligned parallel to the insertion direction of the weft thread (12) and are stationarily arranged, with the needle bar (3) being arranged at a first multiple lever (54*a*, 54*b*, 54*c*) between the first axle and a stationary joint (54), and with the second axle, which is connected to the first axle via a second multiple lever (71*a*, 71*b*, 71*c*), being provided for a pivotal movement of the insertion element (4) which goes up and down; and in that the axles is capable of being set into a pendulum rotation (60, 70) via a cam disc drive (6) with which the first axle is drivable by the drive shaft (81), so as to carry out a stroke displacement at the two multiple levers, namely using multiple or elongate-hole levers (54*c*, 71*c*).

6. Weaving machine in accordance with claim 5, characterized in that for the manufacture of the simple cloth (1') the cam disc drive (6) is a 1:2 stroke-cam arrangement.

7. Weaving machine in accordance with claim 1, characterized in that the shed forming apparatus comprises a drive (9) with which the insertion element (4) and the needle bar (3) or an eyed blade (3') respectively are movable by separate setting means (95, 97).

8. Weaving machine in accordance with claim 4, characterized in that the insertion element (4) is movably arranged at the pivotal arrangement; and in that the cyclic displacement movement (40*b*) for the manufacture of the leno cloth (1) is driven by means of a motor which acts at the insertion element, in particular a linear motor, with this motor being switched off when a simple cloth (1') is being manufactured.

9. A weaving machine for optionally weaving leno cloth and simple cloth comprising a shed forming apparatus for weaving leno cloth, a needle bar and an insertion element for warp threads, the needle bar and the insertion element being reciprocally movable in a first direction, the insertion element being also movable in a second direction that is transverse to the first direction so that leno binding takes place in interplay with an insertion of a weft thread, and a switching arrangement for discontinuing movements of the insertion element in the second direction and for changing a distance the insertion element and the needle bar move in the first direction when it is desired to weave simple cloth.

10. A weaving machine according to claim 9 including a first linkage for moving the needle bar and the insertion elements in the first direction and a drive for moving the insertion element in the second direction, and wherein the switching arrangement comprises means for modifying the first linkage so that, during operation of the weaving machine, movements of the needle bar and the insertion element in the first direction are changed, and means for deactivating the drive for weaving simple cloth.

* * * * *